US006758175B2

(12) United States Patent
Dinkel et al.

(10) Patent No.: US 6,758,175 B2
(45) Date of Patent: Jul. 6, 2004

(54) APPARATUS FOR PURGING AND EXCLUDING AIR FROM A HYDRAULIC MANIFOLD ASSEMBLY FOR VARIABLE DEACTIVATION OF ENGINE VALVES

(75) Inventors: Michael J. Dinkel, Penfield, NY (US); Doug Gnage, Dunkirk, MD (US); Dave Beiswenger, Fishers Landing, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/280,424

(22) Filed: Oct. 25, 2002

(65) Prior Publication Data

US 2004/0079307 A1 Apr. 29, 2004

(51) Int. Cl.[7] ..... F01L 9/02

(52) U.S. Cl. ..... 123/90.12; 123/90.15

(58) Field of Search ..... 123/90.12, 90.15, 123/90.16, 90.17, 320, 321, 322; 251/129.01, 129.02, 129.03, 129.04, 129.05

(56) References Cited

U.S. PATENT DOCUMENTS 4,296,911 A * 10/1981 Escobosa ..... 251/57
4,656,976 A * 4/1987 Rhoads ..... 123/90.12
4,793,307 A * 12/1988 Quenneville et al. ..... 123/323
5,105,782 A * 4/1992 Meneely ..... 123/321
5,386,809 A * 2/1995 Reedy et al. ..... 123/320
5,619,965 A * 4/1997 Cosma et al. ..... 123/322
6,125,828 A * 10/2000 Hu ..... 123/568.14
6,308,671 B1 10/2001 Reed et al.
6,439,176 B1 8/2002 Payne et al.
6,591,796 B1 7/2003 Scott

FOREIGN PATENT DOCUMENTS

DE 3807699 A1 * 9/1989 ..... F01L/9/02

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A hydraulic manifold assembly for variable actuation of engine valves in accordance with the invention includes oil flow galleries. Engine oil under pressure communicates with a global supply gallery in the manifold assembly, from which pressurized oil is supplied selectively via individual supply galleries to each variable actuator for each valve through the action of solenoid valves. At engine startup, all galleries may be empty of oil, or partially filled. A global relief valve at the end of the global supply gallery causes air to be purged immediately upon startup of the engine. Each solenoid and individual gallery is provided with a low pressure relief valve leading back to the crankcase when the solenoid supply valve is closed. A bleed orifice between the global supply gallery and each individual gallery continually bleeds oil under low pressure into the individual gallery, which purges initial air therein. Anti-draining means in each individual gallery keeps the gallery filled when the valve deactivation mechanism is deactuated.

11 Claims, 5 Drawing Sheets

APPARATUS FOR PURGING AND EXCLUDING AIR FROM A HYDRAULIC MANIFOLD ASSEMBLY FOR VARIABLE DEACTIVATION OF ENGINE VALVES

TECHNICAL FIELD

The present invention relates to internal combustion engines; more particularly, to devices for controlling systems in an internal combustion engine; and most particularly, to an improved hydraulic manifold assembly for controlling the flow of engine oil in variable activation and deactivation of valve lifters in an internal combustion engine, wherein air is automatically purged from the supply gallery and individual control galleries, and oil drainage there from is prevented.

BACKGROUND OF THE INVENTION

In conventional prior art four-stroke internal combustion engines, the mutual angular relationships of the crankshaft, camshaft, and valves are mechanically fixed; that is, the valves are opened and closed fully and identically with every two revolutions of the crankshaft, fuel/air mixture is drawn into each cylinder in a predetermined sequence, ignited by the sparking plug, and the burned residue discharged. This sequence occurs irrespective of the rotational speed of the engine or the load being placed on the engine at any given time.

It is known that for much of the operating life of a multiple-cylinder engine, the load might be met by a functionally smaller engine having fewer firing cylinders, and that at low-demand times fuel efficiency could be improves if one or more cylinders of a larger engine could be withdrawn from firing service. It is known in the art to accomplish this by de-activating the valve train leading to pre-selected cylinders in any of various ways, such as providing special valve lifters having internal locks which may be switched off either electrically or hydraulically. Such switching conveniently performed via a hydraulic manifold that utilizes electric solenoid valves to selectively pass oil to the lifters on command from an engine control module (ECM). Such a manifold is referred to in the art as a Lifter Oil Manifold Assembly (LOMA).

A serious problem exists in adapting hydraulic control to valve deactivation. Such systems require hydraulic rigidity for proper operation and as such are highly intolerant of air in either the main gallery or the individual control galleries. Air in these galleries can increase the deactivation response time and also cause variation in response time. Both of these conditions can cause inaccurate activation or deactivation timing, resulting in loss of function and potentially catastrophic engine failure.

It is a principal object of the present invention to provide an improved solenoid-actuated hydraulic manifold assembly for controlling the hydraulic locking and unlocking of deactivatable valve lifters in an internal combustion engine, wherein any air present in the supply or control oil galleries at engine startup is automatically purged from the circuits and is actively prevented from re-entry during the periods of inactivity.

SUMMARY OF THE INVENTION

Briefly described, a hydraulic manifold assembly for variable actuation of engine valves in accordance with the invention includes oil flow passages, or galleries, formed therein. Typically, a riser providing engine oil under pressure communicates with a global supply gallery in the manifold assembly, from which pressurized oil is supplied selectively via an individual supply gallery to each variable actuator for each valve through the action of a solenoid valve disposed between the global supply gallery and each individual supply gallery. At engine startup, all galleries may be empty of oil, or partially filled. A global relief valve at the end of the global supply gallery opposite the oil riser leads back to the crankcase and is set to open at a pressure below the normal operation engine oil pressure. Air in the global supply gallery is thus purged immediately upon startup of the engine, and oil continues to be flowed actively throughout the global gallery at all times, the pressure therein being equal to the opening pressure of the relief valve. Further, each solenoid and gallery is provided with a low pressure relief valve leading back to the crankcase. When the solenoid valve is open, the pressure relief valve is closed; when the solenoid valve is closed, the pressure relief valve is open. A bleed orifice between the global supply gallery and each individual gallery continually bleeds oil under low pressure into each individual gallery, which purges initial air therein but is insufficient to actuate the deactivation mechanism. Further, each individual gallery is provided with anti-draining means to keep the gallery filled while the valve deactivation mechanism is inactive.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
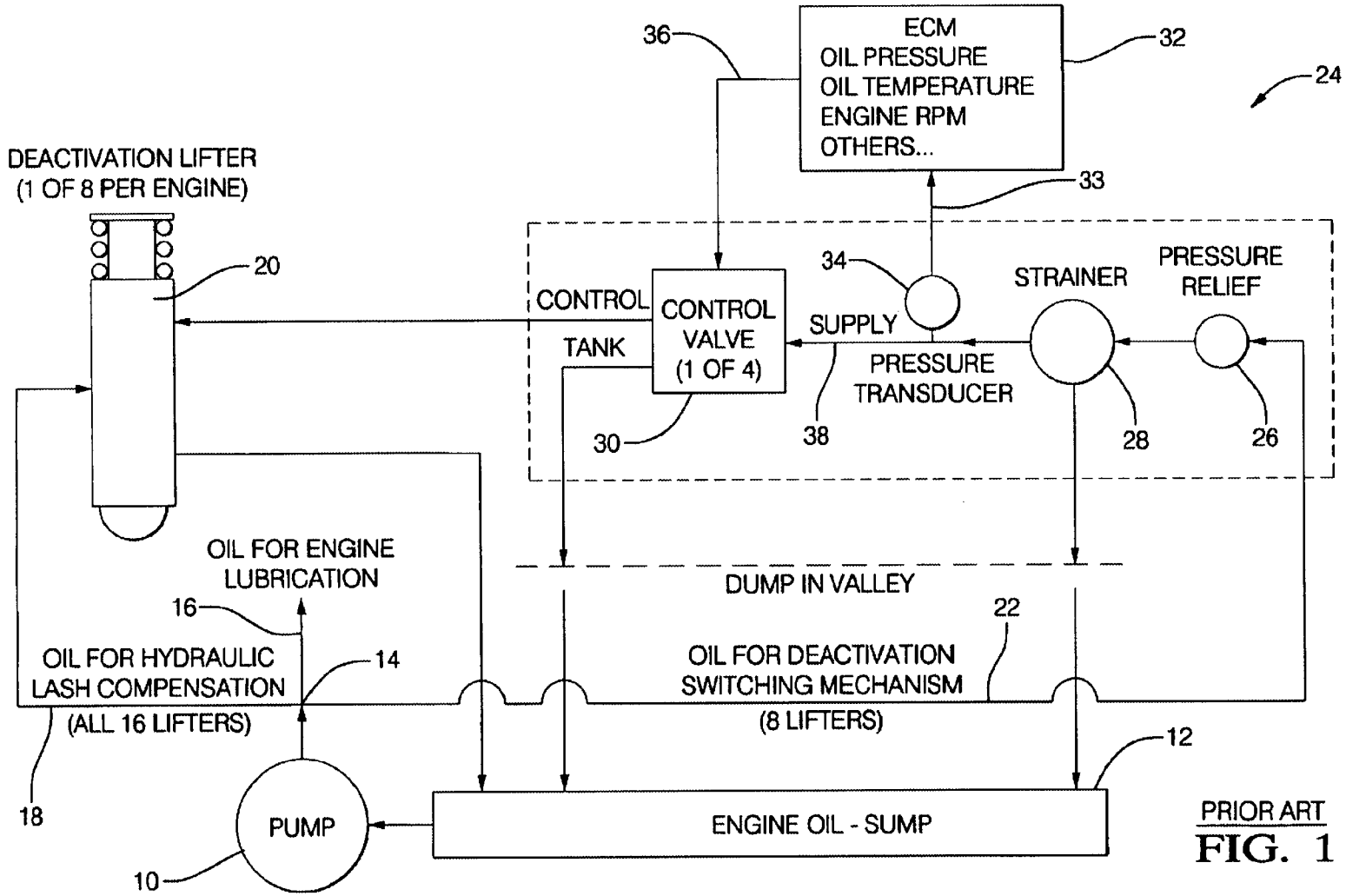
PRIOR ART FIG. 1
FIG. 1 is a schematic drawing of an oil system for an internal combustion engine showing the relationship of a valve deactivation control system to a prior art pressurized oil system.

Referring to FIG. 1, the prior art engine oil circuits for an internal combustion engine are provided with a valve deactivation apparatus. While only a single control valve and lifter are shown in the schematic drawing, it should be understood that valve deactivation is useful only in multiple-cylinder engines for selectively reducing the number of combusting cylinders.

In FIG. 1, an oil pump 10 feeds oil from sump 12 to a juncture 14 where the flow is split three ways. A first portion 16 provides general lubrication the engine. A second portion 18 provides oil conventionally to the hydraulic lifter gallery 19, which support valve deactivation lifters 20. A third portion 22 provides oil to a valve deactivation control system 24. An optional pressure relief valve 26 at the entrance to the system is openable to the sump to maintain pressure in system 24 at a predetermined maximum level. Oil is filtered by strainer 28 and then is supplied via a global supply gallery 38 to a solenoid control valve 30 wherein it is either diverted to the sump 12 of the control valve 30 is not energized, or is diverted to deactivation lifter 20 if the control valve 30 is energized, to cause the associated engine intake and exhaust valves to be deactivated. An engine control module (ECM) 32 receives input signals 33 from a pressure transducer 34 in the control system 24 and integrates via an algorithm such signals with other input operating data such as oil temperature and engine speed to provide output signals 36 to energize or de-energize solenoid control valve 30.

Figure 2:
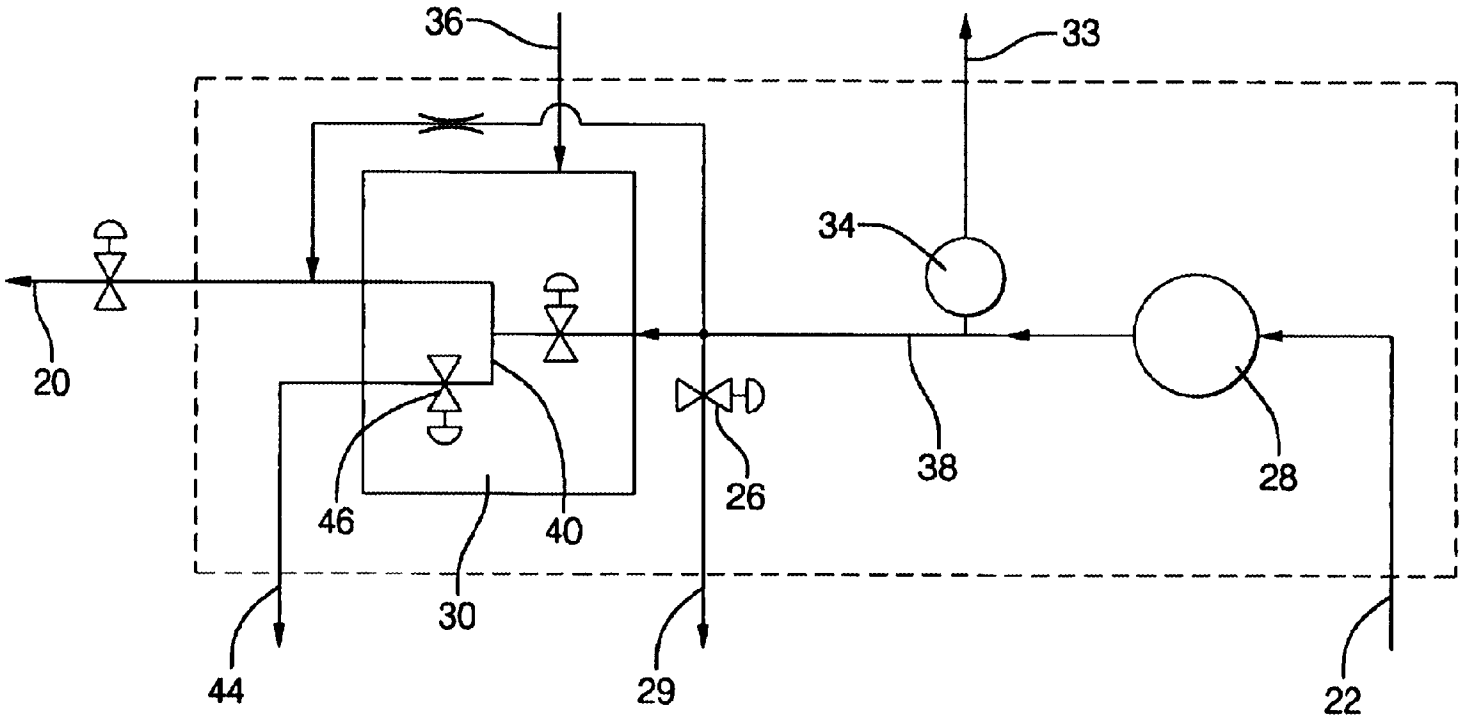
FIG. 2 is an enlarged schematic drawing of a portion of the drawing shown in FIG. 1, showing addition and rearrangement of valving and oil galleries in accordance with the invention.
Figure 3:
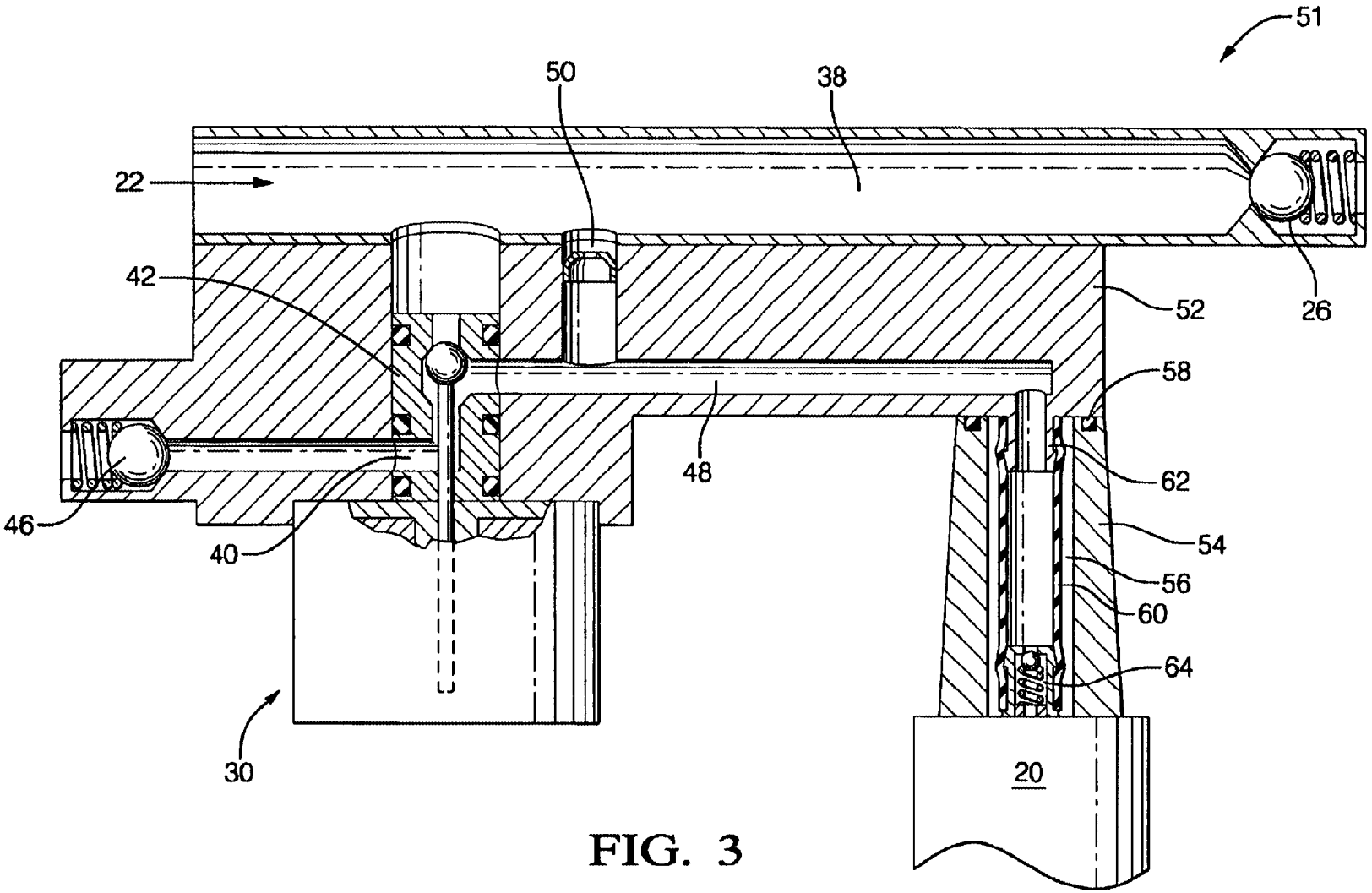
FIG. 3 is a cross-sectional schematic view, not to scale, of a first embodiment of a portion of a hydraulic manifold control system in accordance with the invention.
Figure 4:
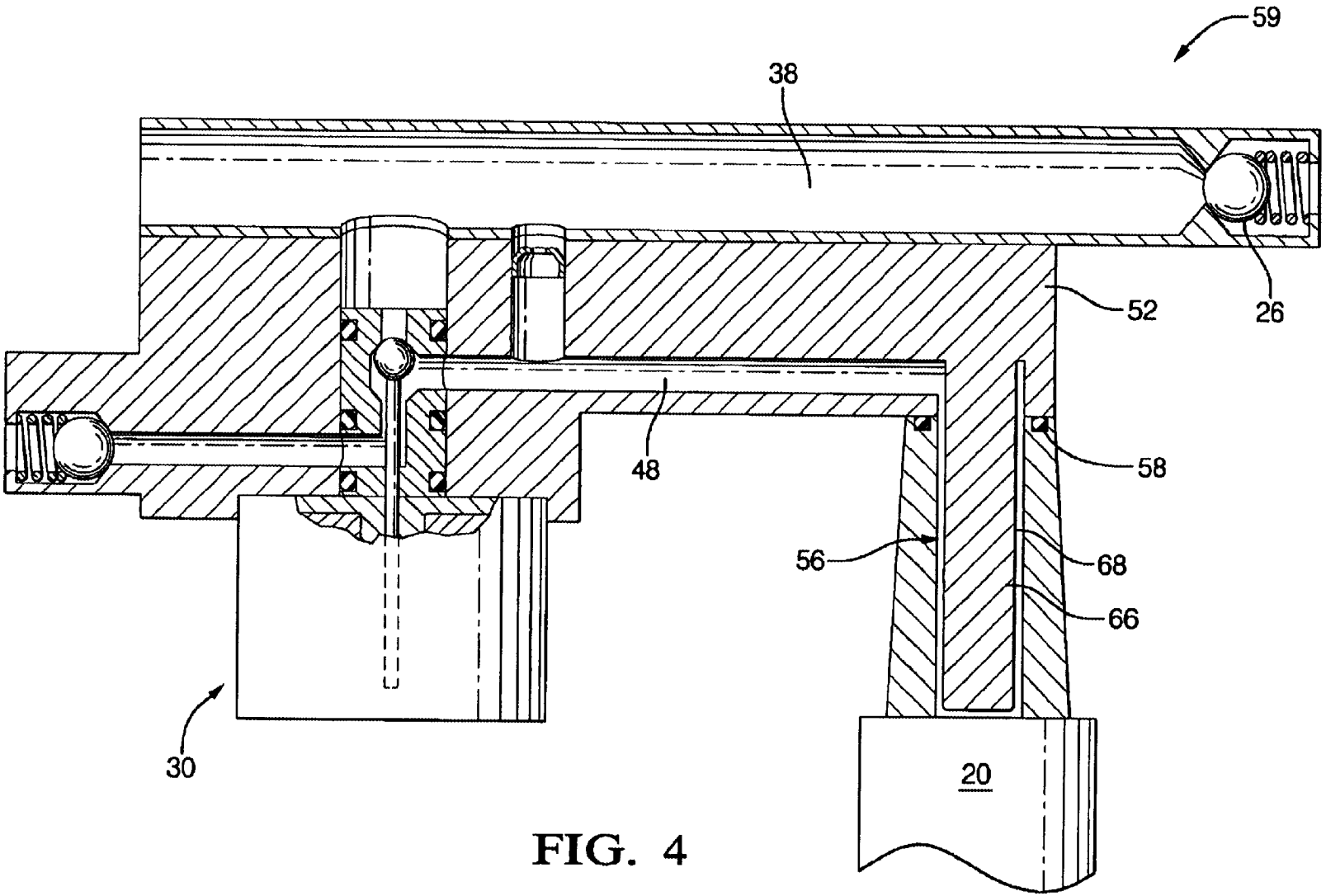
FIG. 4 is a cross-sectional schematic view, not to scale, of a second embodiment of a portion embodiment of a portion of a hydraulic manifold control system in accordance with the invention.

Referring to FIGS. 2 through 4, oil circuits in accordance with the invention are similar to those shown in FIG. 1, with the following implement changes.

First, pressure relief valve 26 leading to drain 29 is moved from the entrance to the global supply gallery 38 to an end thereof adjacent solenoid control valve 30 to permit purging of air from all of the gallery up to the entry to the solenoid control valve. As in the prior art, relief valve 26 is set to establish a desired pressure in the global supply gallery.

Second, a gallery 40 is provided through the seat 42 of solenoid valve 30 in communication with drain line 44, which is provided with a second pressure relief valve 46, and in communication behind valve head 43 with individual gallery 48 when valve 30 is closed to gallery 38, as shown in FIG. 3.

Third, an oil bleed port 50 disposed between global gallery 38 and individual gallery 48, as shown in FIGS. 3 and 4, permits a low volume of oil to fill and then flow through these galleries at all times when the engine is running to purge air therefrom. Preferably, bleed port 50 has a diameter between about 0.25 mm and 0.50 mm. Valve 46 is set to open at a relatively low pressure, for example, 2 psig. Valve 46 thus functions as an anti-draining valve to prevent gallery 40 from draining by gravity when the engine is not running.

Fourth, two different anti-draining means are provided in individual gallery 48, as shown in FIGS. 3 and 4, respectively.

Referring to FIG. 3, in a first arrangement 51, manifold body 52 is mated to engine tower 54 with contains a bore 56 in communication with individual gallery 48 and leading to deactivation valve lifer 20. Tower 54 may be sealed to body 52 as by an O-ring 58 in known fashion. Bore 56 houses an extension 60 of gallery 48 which may comprise, for example, a length of flexible hose attached to body 52 as by a nipple 62. At the distal end of extension 60 is a third pressure relief valve 64 having a very low opening pressure, preferably about 1 psig. Thus, when galleries 40, 48, and 60 have been filled with oil, valves 46 and 64 prevent them from draining by gravity when the engine is shut off. Because drain valve 46 has a higher opening pressure than does valve 64, oil admitted to individual gallery 48 when solenoid valve 30 is opened during operation will open valve 64 preferentially to actuate lifter 20 as intended. When the solenoid valve is closed, pressure capacitance in galleries 40 and 48 is dissipated immediately through valves 46 and 64, but the galleries do not drain and thus are ready for the next demand of lifter 20.

Referring to FIG. 4, an alternate arrangement 59 is shown which is similar to that shown in FIG. 3. However, extension 60 and valve 64 are replaced by a rod 66 connected to manifold body 52 and extending within bore 56 to create an annular space 68 therebetween. Preferably, the radial dimension of space 68 is small, for example, about 0.4 mm as may be achieved when the diameter of bore 56 is 9.0 mm and the diameter of rod 66 is 8.2 mm. A check valve such as valve 64 is obviated, in that oil can flow freely through annular space 68 as needed to actuate lifter 20, but when solenoid valve 30 is closed, surface tension keeps the oil residual in space 68 from draining out.

Figure 5:
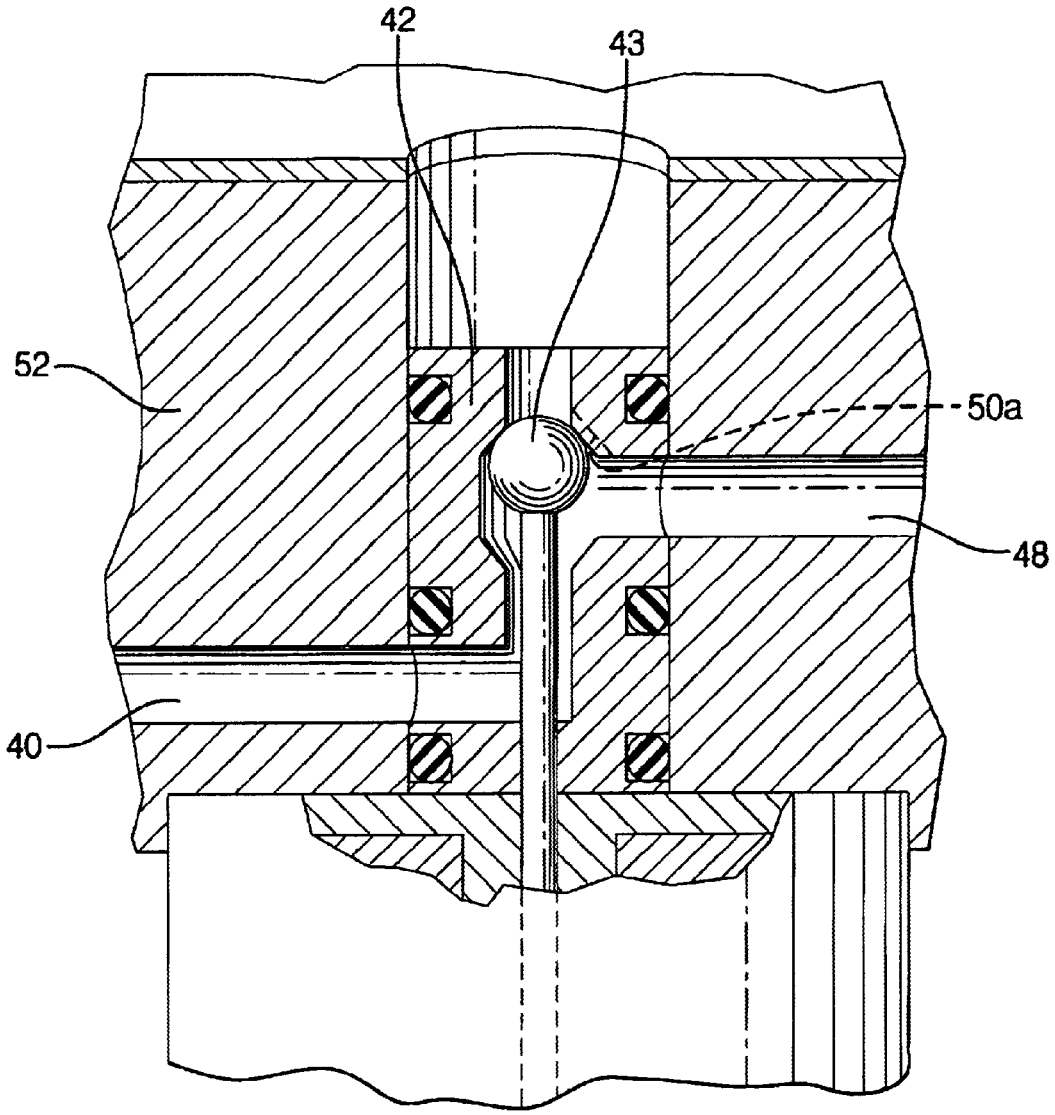
FIG. 5 is an enlarged cross-sectional view of the valve head portion of the hydraulic manifold system shown in FIGS. 3 and 4, showing an oil bleed configuration alternative to that shown in FIGS. 3 and 4.

In either of the embodiments shown in FIGS. 3 and 4, bleed port 50 can be omitted if it is acceptable to allow galleries 40, 48, and 60 to fill upon startup to the engine, for example, during a brief startup protocol the solenoids may all exercised briefly to fill the galleries. Alternatively, referring to FIG. 5, if a bleed is desired, a fixed bleed **50*a* may be formed simply by providing a small groove in the seat 42** of the solenoid valve such that a low volume of oil is continuously bypassed of the solenoid valve.

While the invention has been described by reference to various specific embodiments, it should be understood that changes may be made within the spirit and scope of the inventive concepts described. Accordingly, it is intended that the invention not be limited to the described embodiments, but will have full scope defined by the language of the following claims.

What is claimed is:

1. A hydraulic manifold: assembly 24 for control of a variable valve actuation device for an engine valve wherein air is automatically purged from the assembly and is prevented from re-entering, comprising:

a) a global oil supply gallery 38 in said manifold assembly and having a proximal end for receiving oil from said engine;

b) a first pressure relief valve 26 disposed at a distal end of said global supply gallery for allowing purging of air from said gallery;

c) at least one individual oil supply gallery 48 in said manifold assembly for supplying oil control from said global supply gallery to said variable valve actuation device;

d) a control valve 30 having a valve seat 42 disposed between said global supply gallery and said individual supply gallery for regulating flow of control oil; and e) means 64, 66 for preventing draining of oil from said individual supply gallery.

2. A hydraulic manifold assembly in accordance with claim 1 further compromising oil bleed means 50 between said global supply gallery and said individual supply gallery.

3. A hydraulic manifold assembly in accordance with claim 2 wherein said oil bleed means compromises a bleed orifice 50.

4. A hydraulic manifold assembly in accordance with claim 2 wherein said oil bleed means comprises a groove **50*a*** in said valve seat.

5. A hydraulic manifold assembly in accordance with claim 1 further compromising a drain gallery 40 from said valve seat and a second pressure relief valve 46 disposed in said drain gallery.

6. A hydraulic manifold assembly in accordance with claim 1 wherein said individual supply gallery has a distal end adjacent said variable valve deactuation device and wherein said means for preventing draining includes a third pressure relief valve 64 at said distal end.

7. A hydraulic manifold assembly in accordance with claim 1 wherein said individual supply gallery has a bore terminating at said variable valve deactuation device and wherein said means for draining comprises a rod disposed in said bore to create an annular space therebetween for flow of oil to said variable valve deactuation device, wherein oil is retained by surface tension during periods of inactivity of said device.

8. A hydraulic manifold assembly in accordance with claim 7 wherein the radial thickness of said annular space of about 0.4 mm.

9. An internal combustion engine having a hydraulic manifold assembly for control of a variable valve actuation device for an engine valve wherein air is automatically purged from the assembly and is prevented from re-entering, comprising:

a) a global oil supply gallery 38 in said manifold assembly and having a proximal end for receiving oil from said engine;

b) a first pressure relief valve 26 disposed at a distal end of said global supply gallery for allowing purging of air from said gallery;

c) at least one individual oil supply gallery 48 in said manifold assembly for supplying oil control from said global supply gallery to said variable valve actuation device;

d) a control valve 30 having a valve seat 42 disposed between said global supply gallery and said individual supply gallery for regulating flow of control oil; and e) means 64, 66 for preventing draining of oil from said individual supply gallery.

10. A hydraulic manifold assembly 24 for control of a variable valve actuation device for an engine valve wherein air is automatically purged from the assembly and is prevented from re-entering, comprising:

a) a global oil supply gallery 38 in said manifold assembly and having a proximal end for receiving oil from said engine;

b) a first pressure relief valve 26 disposed at a distal end of said global supply gallery for allowing purging of air from said gallery;

c) at least one individual oil supply gallery 48 in said manifold assembly for supplying oil control from said global supply gallery to said variable valve actuation device;

d) a control valve 30 having a valve seat 42 disposed between said global supply gallery and said individual supply gallery for regulating flow of control oil; and e) means for preventing draining of oil from said individual supply gallery, wherein said individual supply gallery has a bore terminating at said variable valve deactuation device, wherein said means for draining comprises a rod disposed in said bore to create an annular space therebetween for flow of oil to said variable valve deactuation device, and wherein oil is retained by surface tension during periods of inactivity of said device.

11. A hydraulic manifold assembly in accordance with claim 10 wherein the radial thickness of said annular space of about 0.4 mm.

* * * * *